US008823631B2

(12) United States Patent
Tomikawa

(10) Patent No.: US 8,823,631 B2
(45) Date of Patent: Sep. 2, 2014

(54) LIQUID CRYSTAL DISPLAY AND LIQUID CRYSTAL TELEVISION

(75) Inventor: Kazuhiro Tomikawa, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 1480 days.

(21) Appl. No.: 12/288,469

(22) Filed: Oct. 21, 2008

(65) Prior Publication Data

US 2009/0102784 A1 Apr. 23, 2009

(30) Foreign Application Priority Data

Oct. 22, 2007 (JP) ..... 2007-274226

(51) Int. Cl.
*G09G 3/36* (2006.01)
*G09G 3/20* (2006.01)
*G09G 3/34* (2006.01)

(52) U.S. Cl.
CPC ..... *G09G 3/2092* (2013.01); *G09G 2330/022* (2013.01); *G09G 3/3406* (2013.01); *G09G 2320/062* (2013.01)
USPC ..... 345/102; 345/89; 345/589; 348/790

(58) Field of Classification Search
None
See application file for complete search history.

(56) References Cited

U.S. PATENT DOCUMENTS 6,020,879 A 2/2000 Nakabayashi
2003/0112257 A1 6/2003 Tamura
2004/0140972 A1 7/2004 Hirota et al.
2004/0155854 A1 8/2004 Ma et al.
2005/0203927 A1* 9/2005 Sull et al. ..... 707/100
2005/0237292 A1* 10/2005 Kim et al. ..... 345/102
2005/0264516 A1* 12/2005 Oh et al. ..... 345/102
2006/0197875 A1* 9/2006 Muto et al. ..... 348/581
2007/0097065 A1 5/2007 Kreek et al.
2007/0115232 A1* 5/2007 Urisu ..... 345/88
2007/0139353 A1 6/2007 Tseng et al.
2007/0284509 A1* 12/2007 Kobashi ..... 250/206

FOREIGN PATENT DOCUMENTS

JP H11-194736 A 7/1999
JP 2006-243591 A 9/2006
JP 2006-323073 A 11/2006
JP 2007-150967 A 6/2007
JP 2007-155819 A 6/2007

OTHER PUBLICATIONS

The extended European search report dated Dec. 30, 2009.
European Examination report dated Jul. 9, 2010.

* cited by examiner

*Primary Examiner* — Jesus Hernandez
(74) *Attorney, Agent, or Firm* — Yokoi & Co., U.S.A., Inc.; Toshiyuki Yokoi

(57) ABSTRACT

The present invention provides a liquid crystal display capable of making the variations and the oblique lines, which are caused on the screen in the liquid crystal display using the TN liquid crystal panel, less visible. The liquid crystal display includes a video signal reception section adapted to receive a video signal, a signal input detection section adapted to detect presence or absence of the video signal, a luminance control section adapted to control the luminance of the backlight, and a control section adapted to instruct the luminance control section to reduce the luminance of the backlight as a predetermined amount in the case in which the signal input detection section fails to detect the video signal.

8 Claims, 7 Drawing Sheets

LIQUID CRYSTAL DISPLAY AND LIQUID CRYSTAL TELEVISION

CROSS REFERENCE TO RELATED APPLICATIONS

The present application is related to the Japan Patent Application No. 2007-274226, filed Oct. 22, 2007, the entire disclosure of which is expressly incorporated by reference herein.

BACKGROUND OF THE INVENTION

1. Field of the Invention

The present invention relates to a liquid crystal display and a liquid crystal television using a Twisted Nematic (TN) liquid crystal panel to display images.

2. Description of the Related Art

Liquid crystal displays are devices for displaying images using liquid crystal panels adapted to change the light transmission in accordance with voltages applied thereto. As types of the liquid crystal panels, there exist a Twisted Nematic (TN) type, a Vertical Alignment (VA) type, an In-Plane Switching (IPS) type, and an Optically Compensated Bend (OCB) type. Among these types, the TN liquid crystal panels are low in price, and in widespread use.

The TN liquid crystal panel has a structure having nematic liquid crystal with positive dielectric anisotropy intervening between two glass substrates having polarization plates (oriented films) with polarization directions perpendicular to each other formed on the respective surfaces thereof. In the TN type, the axis of the liquid crystal molecule rotates up to 90 degrees between when a voltage is applied and when the voltage is not applied. Further, the light is transmitted when the voltage is not applied, and the transmission of the light is gradually reduced as the voltage applied thereto increases.

Further, the liquid crystal element can be driven with a low voltage, has low power consumption, and has a high contrast property with a wide contrast range.

On the other hand, the TN liquid crystal panels are apt to cause variations or oblique lines on a screen. The TN liquid crystal panels have a rubbing process in forming the pixels. In the rubbing process, grooves are provided to the oriented film transferred on the glass substrate so that the arrangement directions of the liquid crystal molecules become homogenized. Specifically, in the rubbing process, a roller with rubbing cloth wound around the roller is rotated while pressed against the oriented film. On this occasion, if amount and direction of the pressure with which the rubbing cloth is pressed against the oriented film are not even, the grooves cannot uniformly be formed. If the grooves are not uniform, the arrangement of the liquid crystal molecules becomes uneven. Therefore, since there is caused the liquid crystal, which does not have a uniform arrangement after the arrangement of the liquid crystal molecules is changed even if the voltage is applied to reduce the transmission, such liquid crystal causes leakage light, and the leakage light generates the variations and oblique lines on the screen.

In Patent Document 1 (JP-A-2006-323073), in order for enhancing feel of contrast of an image to improve the quality of the image, the luminance of a backlight is controlled in accordance with a state of an input video signal. According to this document, the luminance of the backlight is controlled in accordance with the luminance or the grayscale level of the input video signal.

Further, in Patent Document 2 (JP-A-2006-243591), control is performed when suppressing temperature rise in the inside of a liquid crystal display so that the luminance in the image does not drop beyond a predetermined value.

In Patent Document 3 (JP-A-11-194736), a luminance control range of a backlight is enlarged without complicating the configuration of an inverter circuit.

Further, in Patent Document 4 (JP-A-2007-155819), reduction of the luminance control range is suppressed in a liquid crystal display performing black-insertion driving with a liquid crystal panel of an OCB operation mode. Here, the black-insertion driving is a technology for inserting an image for forming a black display period in a frame separately from the video signal.

Further, in Patent Document 5 (JP-A-2007-150967), when controlling the luminance of the backlight using PWM control, a duty ratio is controlled to extend the life of the backlight.

No technologies disclosed in the Patent Document 1 though 5 are capable of eliminating the variations or the oblique lines on the screen which are inherent in the TN liquid crystal panels. In the related art, the variations and the oblique lines on the screen described above are regarded as being unavoidable problems, and are not improved.

BRIEF SUMMARY OF THE INVENTION

The present invention provides a liquid crystal display capable of making the variations and the oblique lines, which are caused on the screen in the liquid crystal display using the TN liquid crystal panel, less visible.

A liquid crystal display according to the invention comprising a Twisted Nematic (TN) liquid crystal panel and a backlight for emitting light from behind the liquid crystal panel, and varying transmission of each pixel in the liquid crystal panel based on a video signal, thereby displaying an image with the transmitted light transmitted through each pixel of the liquid crystal panel, is arranged to have a configuration including a video signal reception section for receiving the video signal, a signal input detection section for detecting the video signal, a luminance control section for controlling the luminance of the backlight, and a control section for instructing the luminance control section to reduce the luminance of the backlight in a case in which a determination is made that the video signal is absent based on the detection result of the signal input detection section.

According to the invention configured as described above, the luminance control section reduces the luminance of the backlight in the case in which it is determined that the video signal is absent in the video signal reception section based on the detection result of the signal input detection section.

In the TN liquid crystal panels, in the case in which no video signal is input, the leakage light makes the variations and the oblique lines on the screen visible. According to the present invention, the luminance of the backlight as a source of the transmitted light is reduced, thereby making the variations and the oblique lines on the screen less visible without improving the structure of the liquid crystal panel.

Here, the technology for reducing the luminance of the backlight includes all technologies for reducing the luminance within the range not causing problems on driving of the backlight drive section without stopping emission of the backlight.

Further, the video signal includes the data to be a source of an image displayed on the screen, sync signals of the image, and various information for recognizing the image. Therefore, the technology for detecting input of the video signal includes not only the technologies for directly detecting the data to be the source of the image, but also the technologies for indirectly determining presence or absence of the video signal based on the sync signals or the various information attached to the video signal.

In a preferable embodiment of the invention, there is further provided a solid color screen display section for making the liquid crystal panel display a solid color image in a case in which a determination is made that the video signal is absent based on the detection result of the signal input detection section.

According to the invention configured as described above, the solid color screen display section displays a solid color image on the screen in the case in which no video signal is detected.

Here, the solid color image denotes a picture displayed on the screen composed only of solid color without any object or character string. Specifically, a solid color image is displayed on the entire screen with On-Screen Display (OSD).

In another preferable embodiment of the invention, the luminance control section receives an operation input by user to the luminance of the backlight and control the luminance of the backlight in accordance with the operation input, and the control section is adapted to make the luminance control section control the luminance of the backlight so that the luminance becomes lower than a luminance control range corresponding to the operation input the luminance control section receives.

According to the invention configured as described above, the luminance control section reduces the luminance of the backlight to the value lower than the luminance control range designated by the operation input in the case in which no video signal input is detected. Therefore, even in the case in which the variations or the oblique lines are displayed on the screen with the lower limit luminance the user can operate, the luminance value can be reduced to be lower than the lower limit value in the control by the control section, thus the variations and the oblique lines become less visible.

Here, the operation input range denotes the range of the normal luminance control performed other purposes than the purpose of making the variations and the oblique lines displayed on the screen less visible.

In another preferable embodiment of the invention, the luminance control section controls the luminance of the backlight with Pulse Width Modulation (PWM) control for varying a duty ratio of a pulse signal, and the control section instructs the luminance control section to vary the duty ratio of the pulse.

According to the invention configured as described above, it becomes possible that the control section controls the luminance of the backlight using the duty ratio of the pulse signal as a parameter, thus the luminance control becomes easier.

In another preferable embodiment of the invention, the control section instructs the luminance control section to increase the luminance of the backlight in a phased manner in the case in which the signal input detection section detects the video signal after the control section makes the luminance control section perform luminance control for reducing the luminance of the backlight.

According to the invention configured as described above, since the control section raises the luminance from the condition in which the luminance of the screen is reduced in a phased manner, the user watching the screen can keep watching the screen without having uncomfortable feeling.

Here, a phased manner denotes that the luminance increases gradually with a predetermined luminance step.

In another preferable embodiment of the invention, the signal input detection section detects presence or absence of a sync signal in the video signal, and determine presence or absence of the video signal based on a result of the detection on presence or absence of the sync signal.

According to the invention configured as described above, since the signal input detection section detects presence or absence of the video signal based on presence or absence of the sync signal of the video signal, presence or absence of the video signal can more easily and simply be detected.

In another preferable embodiment of the invention, the video signal reception section receives digital television broadcasting, and the signal input detection section detects presence or absence of the video signal based on information stored in broadcast data included in the digital television broadcasting received by the video signal reception section.

According to the invention configured as described above, since the input of the video signal is detected based on the information stored in the broadcast data of the digital television broadcasting, presence or absence of the video signal can more easily and simply be detected.

According to another embodiment of the invention, a liquid crystal television for receiving television broadcasting and displaying an image with a Twisted Nematic (TN) liquid crystal panel includes a video signal reception section for receiving digital broadcasting to obtain a video signal, a solid color screen display section for making the liquid crystal panel display with a predetermined solid color in the case in which the video signal is not obtained, a luminance control section for accepting an operation input to luminance of a backlight and control the luminance of the backlight with PWM control for varying a duty ratio of a pulse signal based on the operation input, a signal input detection section for detecting the video signal based on information stored in broadcast data included in the digital television broadcasting received by the video signal reception section, and a control section for instructing the luminance control section to reduce the luminance of the backlight so as to be lower than a luminance control range corresponding to the operation input accepted by the luminance control section in a case in which a determination is made that the video signal is absent based on the detection result of the signal input detection section, and to instruct the luminance control section to increase the luminance of the backlight in a phased manner in a case in which the signal input detection section detects the video signal after the control section makes the luminance control section perform luminance control for reducing the luminance of the backlight.

DETAILED DESCRIPTION OF THE INVENTION

Figure 1:
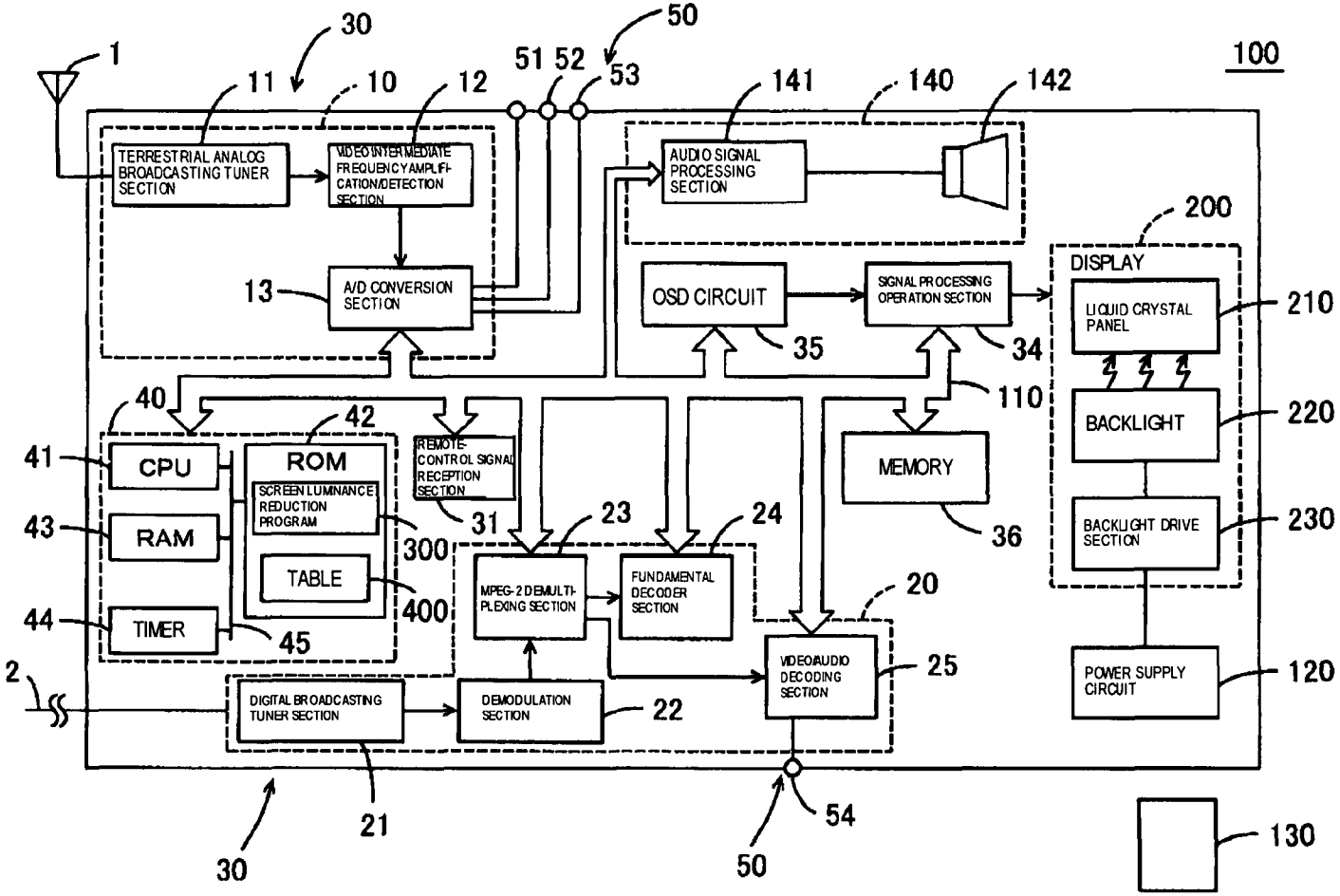
FIG. 1 is a block configuration diagram of a television receiver in an embodiment of the invention.

Hereinafter, an embodiment of the present invention will be explained along the following order. It should be noted that the same or equivalent parts will be denoted with the same reference numerals, and duplication of the explanations therefor will be eliminated.

1.1. Configuration of Television Receiver
1.2. Functions of the Television Receiver
1.2.1. Reception of ATSC/Clear QAM
1.2.2. Reception of NTSC
1.2.3. Reception of Signal From S-Video/Composite Terminal
1.2.4. Reception of Signal From Component Terminal
1.2.5. Reception of Signal From HDMI Terminal
1.2.6. Reception of Signal From PC 1.1. Configuration of Television Receiver FIG. 1 is a block configuration diagram of a television receiver in an embodiment of the invention.

The television receiver 100 receives terrestrial analog television broadcasting via an antenna 1, and digital television broadcasting via a cable, and then outputs pictures and sounds of a program corresponding to a channel tuned by the user with a remote controller 130 and so on. Further, the television receiver 100 is provided with input/output terminals, and is capable of performing mutual data communication with an external device via the input/output terminals. Further, the television receiver 100 has a function of reducing the luminance of the screen while no video signals are input thereto, thereby making the variations or the oblique lines appearing on the screen less visible.

The television receiver 100 is provided with a broadcast reception section 30 for generating a video signal and an audio signal based on a broadcast signal received via the antenna or a cable, a display 200 for displaying images based on the video signal generated by the broadcast reception section 30, a power supply circuit 120 for supplying each sections inside the television receiver 100 with power, a remote controller 130 with which the user remote-controls the television receiver 100, and a sound output section 140 for outputting sounds based on the audio signal generated by the broadcast reception section 30.

The broadcast reception section 30 is provided with an analog broadcast reception/detection section 10 for extracting the video signal and the audio signal from an analog broadcast signal and then executing analog-digital conversion thereon, a digital broadcast reception/demodulation section 20 for extracting the video signal and the audio signal from a digital broadcast signal, a memory 36 for temporarily storing the data of the video signal generated by the analog broadcast reception/detection section 10 or the digital broadcast reception/demodulation section 20, a signal processing operation section 34 for performing arithmetic processing for executing a predetermined signal processing on the video signal data stored in the memory 36, an OSD circuit 35 for synthesizing an On-Screen Display (OSD) image, a remote-control signal reception section 31 for receiving a remote-control input from the remote controller 130, a control section 40 for controlling the broadcast reception section 30, and the input/output terminals 50 through which the mutual data communication is performed with an external device. It should be noted that the constituents of the broadcast reception section 30 are connected to each other via a bus 110 so as to allow mutual communication therebetween. Hereinafter, each of the constituents will specifically be explained.

The analog broadcast reception/detection section 10 receives the terrestrial analog broadcasting via the antenna 1 to detect the video signal and the audio signal corresponding to the channel tuned. The analog broadcast reception/detection section 10 is provided with a terrestrial analog broadcasting tuner section 11, a video intermediate frequency amplification/detection section 12, and an A/D conversion section 13. It should be noted that in the present embodiment, the terrestrial analog broadcasting the antenna 1 receives uses a National Television System Committee (NTSC) analog television broadcast signal. However, the form of broadcasting is not limited thereto, but Phase Alternation by Line (PAL) and Sequential Color And Memory (SECAM) can also be adopted.

The terrestrial analog broadcasting tuner section 11 converts a composite signal corresponding to the channel tuned with the remote controller 130 and so on from the terrestrial analog broadcast signal the antenna 1 receives into an intermediate frequency signal. The video intermediate frequency amplification/detection section 12 amplifies the intermediate frequency signal, and detects the video signal and the audio signal from the signal obtained by the amplification. The A/D conversion section 13 executes A/D conversion on the video signal detected by the video intermediate frequency amplification/detection section 12, and then temporarily stores the result in the memory 36. Further, the A/D conversion section 13 is connected to the S-Video/Composite terminal 51 (described later), the Component terminal 52 (described later), and the S terminal 53 as the input/output terminals 50, and executes A/D conversion on analog signals input from the respective terminals described above. It should be noted that the video signal stored in the memory 36 is assumed to include the color signal, the luminance signal, and also the sync signal composed of the horizontal sync signal and the vertical sync signal.

The digital broadcast reception/demodulation section 20 receives the digital broadcast signal transmitted via the cable 2, and demodulates the video signal and the audio signal corresponding to the channel tuned. The digital broadcast reception/demodulation section 20 is provided with a digital broadcasting tuner section 21, a demodulation section 22, an MPEG-2 demultiplexing section 23, a fundamental decoder section 24, and an MPEG-2 video/audio decoding section 25. It should be noted that in the present embodiment, the digital broadcast signal the digital broadcast reception/demodulation section 20 receives is of the ATSC/Clear QAM digital broadcasting. However, the digital broadcasting the digital broadcast reception/demodulation section 20 receives is not limited thereto.

The digital broadcasting tuner section 21 extracts a modulation signal of the channel tuned with the remote controller 130 from the digital broadcast signal transmitted via the cable 2. The demodulation section 22 extracts digital data from the modulation signal extracted by the digital broadcasting tuner section 21. Here, the digital data extracted by the demodulation section 22 is, for example, Moving Picture Experts Group 2 Transport Stream (MPEG-2 TS, hereinafter described as TS).

Figure 2:
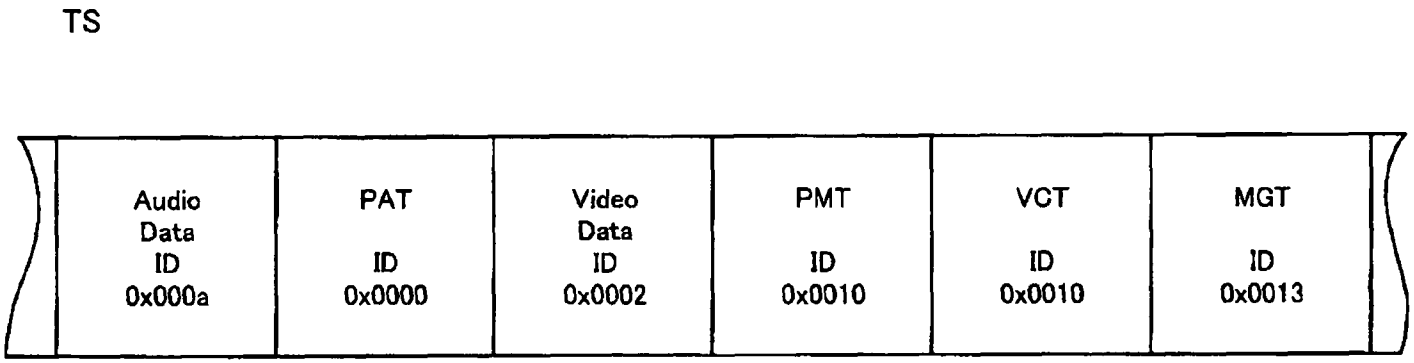
FIG. 2 is a diagram for explaining TS compliant to the ATSC standard as an example.

FIG. 2 is a diagram for explaining the TS compliant to the ATSC standard. The TS is formed of an aggregate of a plurality of packets as data having a predetermined amount of information. According to the ATSC standard, video data, audio data, data broadcasting contents, Program Specific Information (PSI) as program specifying information, Service Information (SI) as an EPG information, and Program and System Information Protocol (PSIP) information are stored in the respective packets. Further, each of the packets stores a Packet Identifier (PID) as an ID for identifying the packet, and filtering of the packet is performed looking up the PID.

It should be noted that the PSI information is required when filtering necessary packets from the TS. There are two kinds of PSI, one is Program Map Table (PMT) information as a table used for specifying the packets in the TS, and the other is Program Association Table (PAT) information as a table used for specifying the packet the PMT of which is under transfer. The PAT includes PID and so on used for identifying the PMT of that service. There are two kinds of PSIP information, one is a Virtual Channel Table (VCT) as a table of virtual channels, and the other is a Master Guide Table (MGT).

The MPEG-2 demultiplexing section 23 identifies and separates the PSI, the SI, and the PSIP information from each other based on the TS thus decoded, and outputs the information to the fundamental decoder section 24.

The fundamental decoder section 24 composes the EPG using the SI. Further, the fundamental decoder section 24 outputs the PSI and PSIP information to the control section 40 in order for tuning the channel received in the digital broadcasting tuner section 21. The PSI and the PSIP information input in the control section 40 are used for detecting the necessary packets from the TS, or used when detecting whether or not the video signal is included in the TS.

The video/audio decoding section 25 extracts the video signal and the audio signal tuned from the TS based on the PID specified with the PMT information or the VCT information, and then decodes the signals. It should be noted that the video signal thus decoded is temporarily stored in the memory 36. Further, the video/audio decoding section 25 is also connected to an HDMI terminal 54 (described later) as the input/output terminals 50. Further, the video/audio decoding section 25 decodes the video signal and the audio signal from the signal input from the HDMI terminal, and temporarily stores the video signal in the memory 36.

The signal processing operation section 34 executes the arithmetic processing for executing predetermined signal processing on the video signal stored in the memory 36. Further, the signal processing operation section 34 can also combine the image and so on generated by the OSD circuit 35 with the video signal. The OSD circuit 35 generates the OSD image, and outputs the image thus generated to the signal processing operation section 34.

The remote-control signal reception section 31 receives a command transmitted from the remote controller 130, and outputs the control signal based on the control command to the control section 40. As a specific example of the control command, there can be cited a command corresponding to the tuning operation for tuning the channels, and a command corresponding to an input/output switching operation for switching the input/output terminals 50 to be used.

The control section 40 is provided with a Central Processing Unit (CPU) 41, a Read Only Memory (ROM) 42 for storing a program and a table with which the CPU 41 executes various kinds of operations, a Random Access Memory (RAM) 43 for temporarily stores the results of the operations by the CPU 41 together with the program and the table stored in the ROM 42, and a timer 44 for providing a timepiece function to the CPU 41. Further, these constituents are connected to the bus 45 so as to communicate with each other.

The CPU 41 controls the television receiver 100 along the program stored in the ROM 42. For example, in the case of watching the digital broadcasting, the CPU 41 obtains necessary information from the PSI or the PSIP information, and retrieves the packet(s) to be the target of decoding from the memory 36. The packet(s) thus retrieved are output to the video/audio decoding section 25, and then decoded by the video/audio decoding section 25.

Further, in the case of watching the analog broadcasting programs, the CPU 41 detects whether or not the sync signal is included in the video data stored in the memory 36, and judges presence or absence of the video signal based on the result of the detection. Further, the CPU 41 outputs a luminance control signal for executing luminance control on the screen luminance is output to the display 200.

The ROM 42 stores a screen luminance reduction program 300 the CPU 41 executes in order for reducing the screen luminance of the display 200 when the video signal is absent. Further, the ROM 42 stores a table 400 having the information recorded, which is used for judging presence or absence of the video signal when the CPU executes the screen luminance reduction program 300. This information corresponds to a video signal reception section. Here, the video signal reception section is a region for receiving the video signal, and in the present embodiment, analog broadcast reception/detection section 10, the digital broadcast reception/demodulation section 20, and input/output terminals 50 forms the video signal reception section. Further, by executing the screen luminance reduction program 300, the CPU 41 realizes a function of a signal input detection section adapted to detect presence or absence of the video signal, and a function of the control section adapted to reduce the screen luminance based on the result of the video signal detection. It should be noted that the screen luminance reduction program 300 will specifically be explained later.

The present television receiver 100 performs mutual communications with an external device (not shown) with a predetermined protocol via the input/output terminals 50. The input/output terminals 50 of the present television receiver 100 are categorized into four types, namely the S-Video/Composite terminal 51 for transmitting a composite signal having the RGB color signal and the luminance signal combined with each other, the Component terminal 52 for transmitting the luminance signal and the color-difference signal independently, the S terminal 53 for connecting the personal computer (hereinafter described as PC) and the present television receiver 100 to each other, and the High-Definition Multimedia Interface (HDMI) terminal 54 for transmitting the digitalized video signal and audio signal. It should be noted that the control section 40 performs the control for switching the terminal to be used between the input/output terminals 50.

The display 200 displays an image based on the video signal generated by the broadcast reception section. The display 200 is provided with a liquid crystal panel 210 for displaying the image, a backlight 220 as a light source, and a backlight drive section 230 (a luminance control section) for controlling drive of the backlight. It should be noted that the operation mode of the liquid crystal panel 210 is Twisted Nematic (TN), and the size of the liquid crystal panel 210 is equal to or smaller than 26 inches.

The liquid crystal panel 210 generates drive voltages based on the video signal, and applies the drive voltages to the respective pixels. Thus, the transmissions of the respective pixels vary. In the present liquid crystal panel 210, a corresponding number of pixels to the resolution are arranged in a matrix. Further, each of the pixels is filled with a liquid crystal material, and the arrangement of the liquid crystal molecules varies in accordance with the voltage value of the drive voltage applied thereto. Further, R (red), G (green), and B (blue)

color films are attached so as to cover the pixels, respectively. In the liquid crystal panel 210, an internal drive circuit executes digital-analog conversion on the video signal to generate the drive voltages, and applies the drive voltages to the respective pixels. Therefore, each of the pixels provided with either one of the RGB color films attached thereto varies the transmission to the light emitted from the backlight 220 in accordance with the drive voltage applied thereto to represent the gray-scale value of every pixel.

The backlight 220 is a light source for the liquid crystal panel 210. The backlight 220 is provided with a plurality of discharge lamps, and emits light from each of the discharge lamps with high-frequency power supplied from the backlight drive section 230. Cold-cathode tubes are used as the discharge lamps. Further, although the backlight 220 is a direct backlight, a side backlight can also be adopted.

Figure 3:
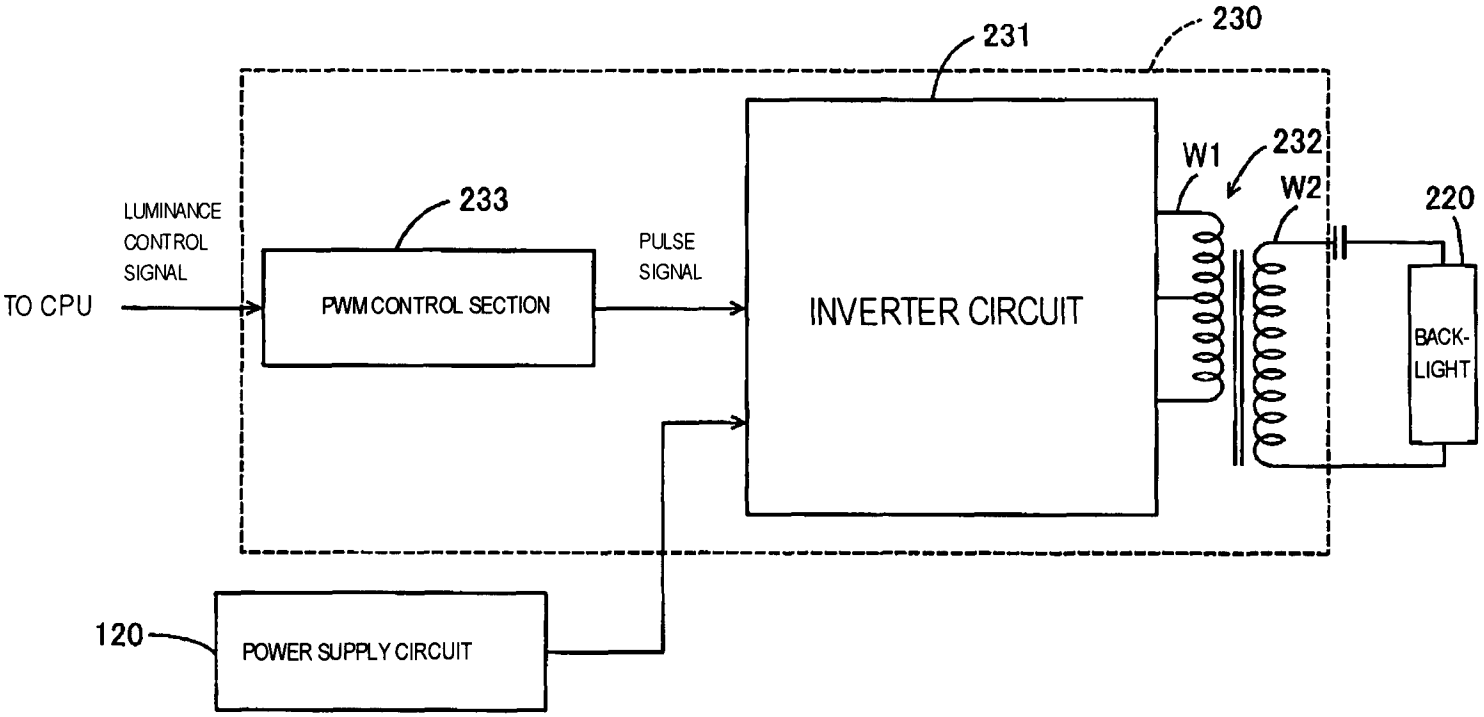
FIG. 3 is a block diagram for explaining a backlight and a backlight drive section.

FIG. 3 is a block diagram for explaining the backlight and the backlight drive section. The backlight drive section 230 controls light emission of the backlight 220. The backlight drive section 230 is provided with an inverter circuit 231 for converting the direct-current power supplied from the power supply circuit 120 into high-frequency alternating-current power, a transformer 232 for supplying the backlight 220 with the high-frequency power generated by the inverter circuit 231, and a PWM control section 233 for controlling (PWM control) the high-frequency power generated by the inverter circuit 231 with the duty ratio of a pulse signal.

When the power supply circuit 120 supplies the backlight drive section 230 with the direct-current power, the inverter circuit 231 of the backlight drive section 230 generates the high-frequency power with an oscillation operation to apply the power to the primary coil W1 of the transformer 232. The high-frequency power applied to the primary coil W1 of the transformer 232 causes a high-frequency voltage on the secondary coil W2 thereof with the self-induction of the transformer 232, and this voltage is supplied to the backlight 220 connected to the secondary coil W2. Further, the PWM control section 233 controls the oscillation of the inverter circuit 231 with the duty ratio of the pulse signal to control the voltage value of the high-frequency power induced to the secondary coil of the transformer 232.

Then, an example of luminance control executed by the PWM control section 232 will hereinafter be explained.

The CPU 41 of the control section 40 is connected to the PWM control section 232, and the CPU 41 transmits the luminance control signal to the PWM control section 232. In response to reception of the luminance control signal, the PWM control section 232 outputs the pulse signal having the duty ratio corresponding to the luminance control signal to the inverter circuit 231. Assuming that the inverter circuit 231 oscillates in a self-excited manner with a control IC, when the duty ratio of the pulse signal is lowered, the oscillating frequency of the inverter circuit 231 is lowered, thus the voltage value of the high-frequency power caused in the secondary coil of the transformer 232 becomes lower. It should be noted that the PWM control section 233 stores a table for providing a relationship between the luminance control signal output by the CPU 41 and the duty ratio of the pulse signal in order for making the both party have correspondence therebetween. Further, it is possible to provide a circuit for judging the relationship between the luminance control signal and the duty ratio of the pulse signal inside the PWM control section 233.

The sound output section 140 outputs sounds based on the audio signal generated by the broadcast reception section 30. The sound output section 140 is provided with an audio signal processing section 141 for executing amplification and signal processing on the audio signal thus input at the same time, and a speaker 142 for outputting the audio signal as sounds, on which the signal processing is executed.

Then, functions of the television receiver 100 with the configuration described above will hereinafter be explained.

1.2. Functions of the Television Receiver 1.2.1. Reception of ATSC/Clear QAM

Hereinafter, the functions of the present television receiver 100 when receiving an ATSC/Clear QAM broadcast signal will be explained. The present television receiver 100 receives the ATSC/Clear QAM broadcast signal. Further, while no video signal is received, the CPU 41 lowers the screen luminance, thus the variations and oblique lines displayed on the screen become less visible. It should be noted that the criterion with which the CPU 41 determines that no video signal is input is either one of the following criteria.

No TS is detected.

The channel number corresponding to the tuned physical channel number cannot be found in either of the VCT and the PAT.

The PID of either one of the video signal and the audio signal of the channel, which is the tuning target identified with the VCT or PAT, cannot detected within one second.

Figure 4:
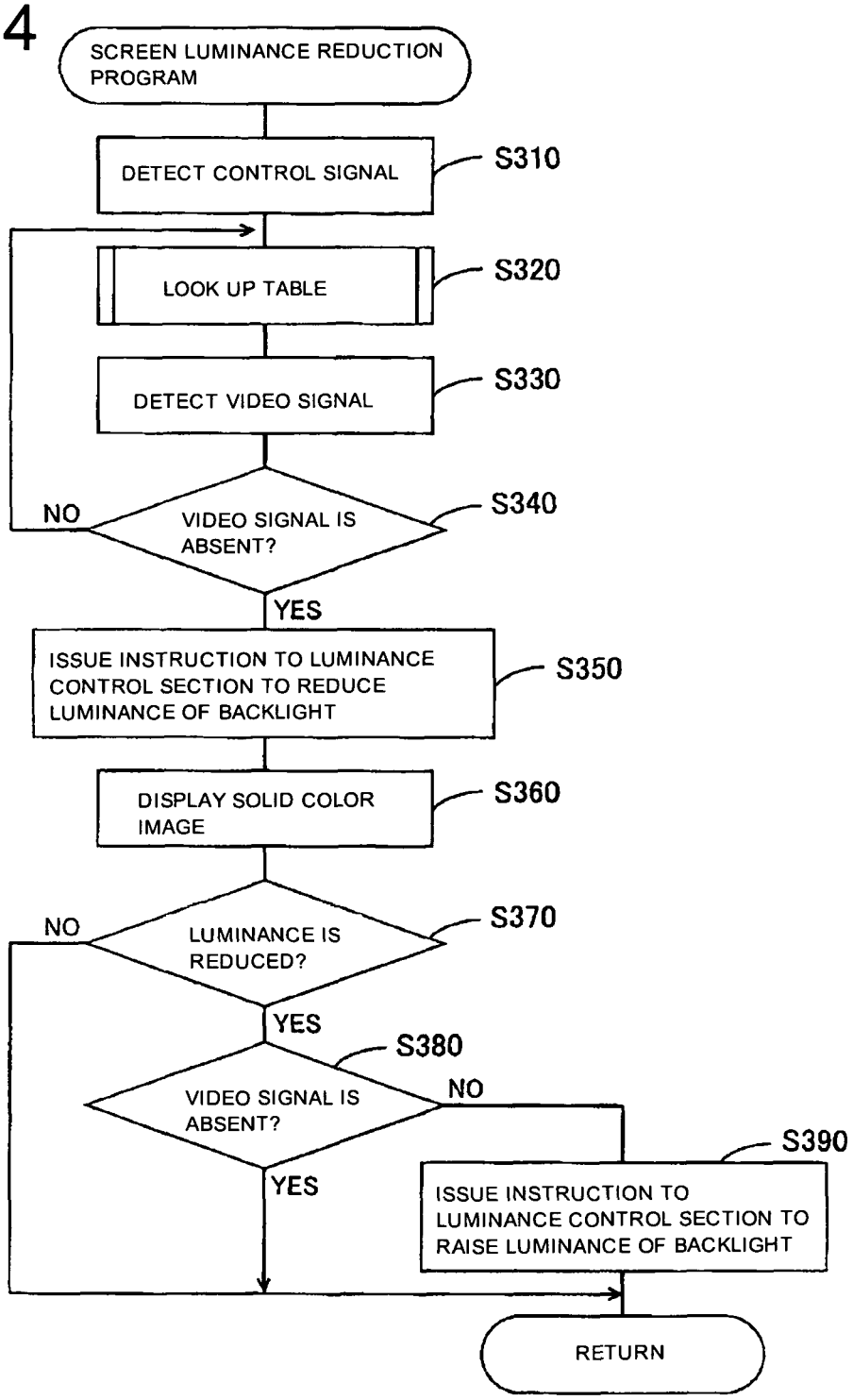
FIG. 4 is a flowchart for explaining a screen luminance reduction program.

FIG. 4 is a flowchart for explaining the screen luminance reduction program.

Firstly, the CPU 41 receives the control signal for switching the video signal reception section from the remote-control signal reception section 31 (step S310), the CPU 41 retrieves the table 400 from the ROM 42, and develops the table 400 on the RAM 43 (step S320). The table 400 stores the criteria, which the CPU 41 uses when judging that the video signal is absent, together with the correspondence with the video signal reception section thus selected. In the case in which the video signal reception section thus selected is the digital broadcast reception/demodulation section 20, the table 400 stores parameters corresponding to the three criteria described above as the criteria corresponding to the digital broadcast reception/demodulation section 20. The CPU 41 looks up the parameters of the judgment criteria stored in the table, and judges the presence or absence of the video signal along the following process.

The CPU 41 looks up the table 400, and judges presence or absence of the video signal corresponding to the digital broadcast reception/demodulation section 20 (step S340). Firstly, the CPU 41 judges whether or not the TS is input. Specifically, the CPU 41 looks up the memory 36 to judge whether or not some sort of TS is stored in the memory 36. If the memory does not store any TS, the CPU 41 determines that the video signal is absent.

Further, if the memory 36 stores some sort of TS, the CPU 41 detects the channel number information of the physical channel tuned presently from the VCT as the PSIP information the fundamental decoder 24 has transmitted to the control section 40, or the PAT as the PSI. On this occasion, if the channel number information of the physical channel thus tuned cannot be found either of the VCT and the PAT, the CPU 41 determines that the video signal is absent.

If the channel number information of the physical channel has been detected in either the VCT or the PAT, the CPU 41 identifies the PID of the packet storing the video signal or the audio signal corresponding to the channel tuned presently based on the VCT or the PAT. Further, if the identified PID is not detected within one second, the CPU 41 determines that the video signal is absent. The CPU 41 determines one second using the timepiece function based on the function of the timer 44.

When the CPU 41 determines that the video signal is absent in the step S330 (step S340), the CPU 41 reduces the screen luminance of the display 200 (step S350). Specifically, when the CPU 41 outputs the luminance control signal to the backlight drive section 230, the PWM control section 233 of the backlight drive section 230 varies the duty ratio of the pulse signal, and accordingly, the voltage value of the high-frequency power supplied to the backlight 220 is lowered.

On this occasion, the luminance value of the backlight 220 thus lowered is arranged to be lower than the range of the normal luminance control the backlight derive section 230 execute in accordance with the setting operation by the user. In the case in which the variations and oblique lines are displayed on the screen with the lowest luminance value which can be set by the user's operation, it is required to set the screen luminance to be lower than the lowest luminance value in order for making the variations and the oblique lines less visible. Therefore, the CPU 41 outputs the luminance control signal, with which the luminance lower than the luminance corresponding to the luminance control signal output in the case of performing the luminance control in accordance with the setting operation by the user is obtained, to the PWM control section 233. It should be noted that the range of the luminance control corresponding to the setting operation by the user denotes the range of the luminance control performed for the purposes other than the purpose of making the luminance variations or the oblique lines appearing on the screen less visible. For example, the luminance control with the remote controller 130 and the luminance control automatically executed in accordance with the video signal are relevant thereto. Further, the lower limit of the luminance in the luminance control the backlight drive section 230 executes along the screen luminance reduction program 300 is within the range in which the emission of the backlight does not completely stop, and within the range in which the inverter circuit 231 can be driven without any problem.

Further, the CPU 41 makes the OSD circuit 35 generate a monochrome image and output the monochrome image to the signal processing operation section 34 (step S360). The monochrome image denotes a monochrome picture excluding objects and characters. Specifically, an all black image making the entire screen solid black, and an all blue image making the entire screen solid blue correspond to the monochrome picture. It should be noted that the user can arbitrarily select the all black image and the all blue image. According to the process of the step S360, the solid black screen or the solid blue screen appears. The CPU 41 realizes the function of a solid color screen display section by the process of the step S360.

After the screen luminance is lowered, the CPU 41 raises the screen luminance (step S390) in response to detection of the video signal (steps S370 and S380). Specifically, the case in which the CPU 41 detects either one of the packet of the video signal and the packet of the audio signal of the physical channel or the virtual channel tuned presently is relevant thereto. In this case, the CPU 41 does not raise the luminance of the backlight 220 up to a predetermined luminance value at a time, but raises the luminance value during a predetermined period of time in a phased manner. This is for preventing the user watching the screen from feeling uncomfortable on the rapid change in luminance. The CPU 41 looks up the table corresponding to the respective amounts of rise, and varies the duty ratio of the pulse signal output to the backlight 220 gradually during a predetermined period of time.

As a result of this process, the screen luminance is lowered in the no signal state, thus the variations and the oblique lines on the screen become less visible.

1.2.2. Reception of NTSC

The function of the present television receiver 100 in the case of receiving an NTSC broadcast signal will hereinafter explained. It should be noted that the case of receiving the NTSC signal denotes the case in which the analog broadcast reception/detection section 10 is selected as the video signal reception section. The criterion for determining that the video signal is absent in the step S340 of the screen luminance reduction program 300 in the case of receiving the NTSC signal is as follows.

No video signal is detected.

In the step S340 of the screen luminance reduction program 300 shown in FIG. 4, the CPU 41 judges whether or not the horizontal sync signal is present based on the video signal stored in the memory 36.

Figure 5:
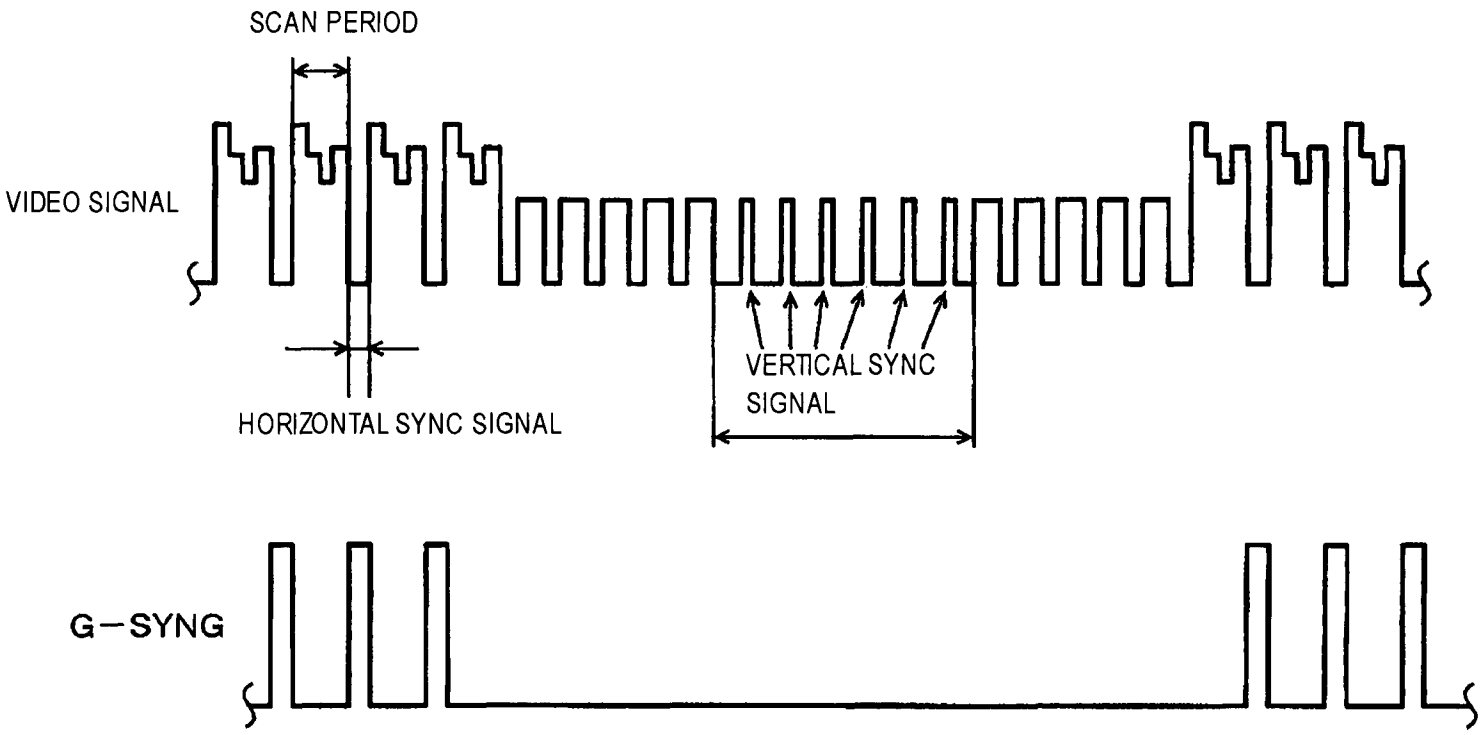
FIG. 5 is a diagram for explaining a video signal and a G-SYNC signal corresponding to a horizontal sync signal in the video signal.

FIG. 5 is a diagram for explaining the video signal and a G-SYNC signal corresponding to the horizontal sync signal in the video signal. As shown in FIG. 5, in the flyback periods anterior and posterior to the scan periods in the video signal, there is combined the horizontal sync signal. Further, the CPU 41 generates the G-SYNC signal in order for detect the horizontal sync signal, and the G-SYNC signal is a signal obtained by inverting the voltage level of the horizontal sync signal. The CPU 41 compares the voltage level of the G-SYNC signal with a predetermined threshold level, and determines that the video signal is present if the voltage level of a corresponding region of the G-SYNC signal to the horizontal sync signal is equal to or higher than the threshold level. It should be noted that the determination method of the sync signal is nothing more than an example, and the determination method the CPU uses for the judgment is not limited thereto.

The process executed by the CPU 41 in the steps S330 through S370 is substantially the same as in the case of receiving the ATSC/Clear QAM, and the explanations therefor will be omitted.

The criteria with which the CPU 41 resets the backlight 220 to the normal luminance state in the step S380 are as follows.

The CPU 41 detects input of the video signal, and the transition from the state in which no video signal is detected to the state in which the video signal is detected does not occur again within two seconds after the detection of the input of the video signal.

The CPU 41 successfully detects the video signal, and the transition from the state in which no video signal is detected to the state in which the video signal is detected has occurred besides the present successful detection within two seconds before the present successful detection of the video signal.

Figure 6:
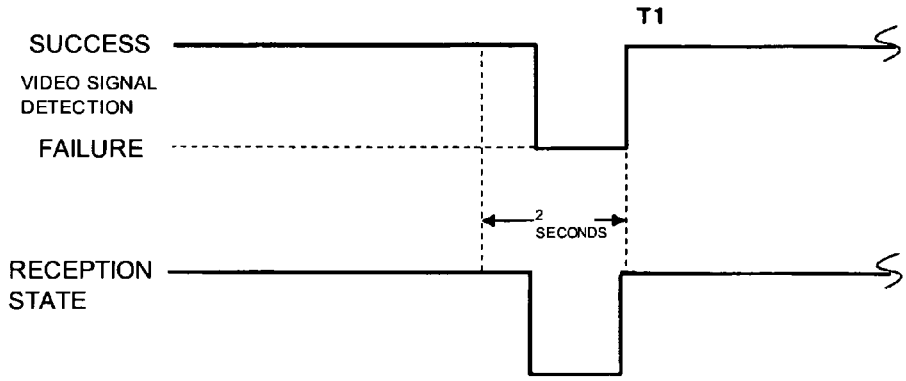
FIG. 6 is a diagram for explaining a relationship between detection of the video signal and the reception state.
Figure 7:
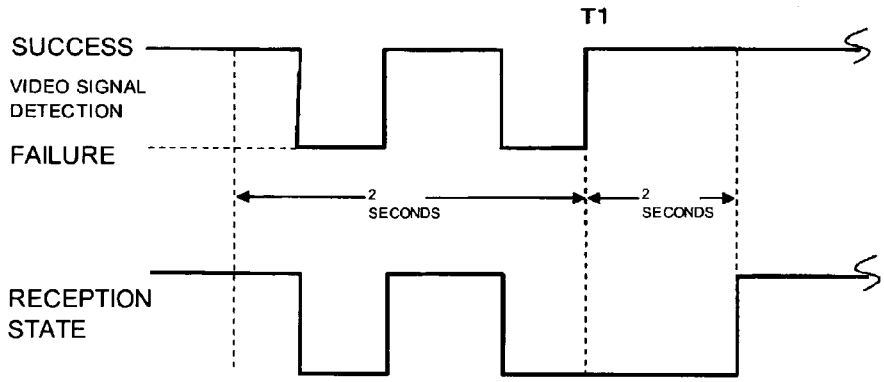
FIG. 7 is a diagram for explaining the relationship between detection of the video signal and the reception state.

FIGS. 6 and 7 are diagrams for explaining the relationship between detection of the video signal and the reception state. In FIG. 6, in the case in which the CPU 41 detects the video signal at the timing T1, there has been no transition from the state (the low level) in which detection of the video signal has been unsuccessful to the state (the high level) in which the video signal has been detected within two seconds prior to this event. Therefore, the CPU 41 determines that the input of the video signal is present. Further, in FIG. 7, in the case in which the CPU 41 detects the video signal at the timing T1, there has been the transition from the state (the low level) in which detection of the video signal has been unsuccessful to the state (the high level) in which the video signal has been detected within two seconds prior to this event. However, the state in which the video signal has been detected is held for two seconds after the timing T1. Therefore, the CPU 41 determines that the input of the video signal is present. The reception state is stored in the memory in the CPU 41 as a flag value. The CPU 41 looks up the transition of the reception state stored in the memory, thereby making the judgment described above. Further, the criteria described above are criteria for preventing the CPU 41 from making a misjudgment due to temporary input of the video signal or noise.

1.2.3. Reception of Signal from S-Video/Composite Terminal

The function in the case in which the present television receiver 100 receives a signal form the S-Video/Composite terminal 51 will hereinafter be explained. In the case in which the S-Video/Composite terminal 51 is selected as the video signal reception section, the judgment that the video signal is absent is made in the step S340 of the screen luminance reduction program 300 if the two criteria described below are satisfied, and this state continues for two seconds.

No horizontal sync signal is detected.

The detected amplitude of the video signal is no greater than a predetermined value.

In the step S340 of the screen luminance reduction program 300 shown in FIG. 4, the CPU 41 judges presence or absence of the horizontal sync signal of the video signal stored in the memory 36, and detects the amplitude of the video signal. The method with which the CPU 41 makes the judgment on presence or absence of the horizontal sync signal is the same as in the case of receiving the NTSC signal, and therefore, the explanation therefor will be omitted here.

In order for detecting the amplitude of the video signal, the CPU 41 obtains the amplitude of the video signal in one frame stored in the memory 36 to compare the amplitude with a predetermined threshold value. On this occasion, if the period in which the sync signal is not detected, and the amplitude of the video signal keeps no higher than the predetermined threshold is equal to or longer than two seconds, the CPU 41 determines that the video signal is absent.

Figure 8:
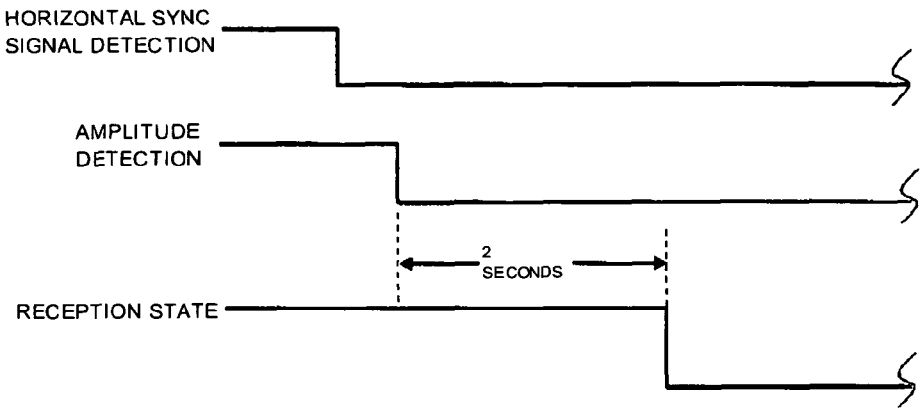
FIG. 8 is a diagram for explaining the relationship between detection of the video signal, detection of the amplitude, and the reception state.
Figure 9:
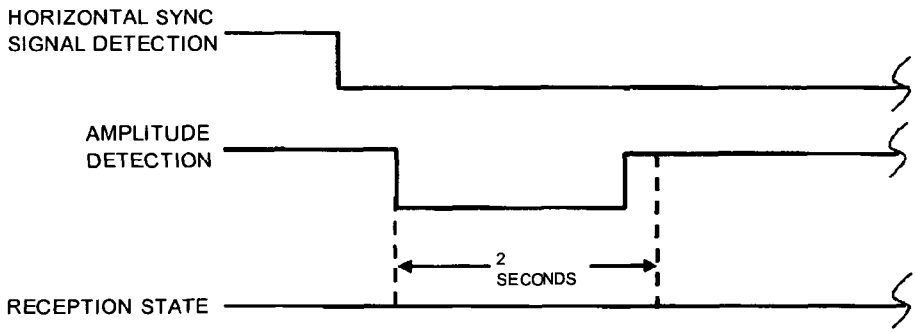
FIG. 9 is a diagram for explaining the relationship between detection of the video signal, detection of the amplitude, and the reception state.

FIGS. 8 and 9 are diagrams for explaining the relationship between detection of the horizontal sync signal, detection of the amplitude of the video signal, and the reception state. In FIG. 8, no horizontal sync signal is detected (the low level), the amplitude of the video signal is thereafter no greater than the threshold value (the low level), and these states continue for a period no shorter than two seconds. Therefore, the CPU 41 determines that the video signal is absent. Further, in FIG. 9, the state, in which no horizontal sync signal is detected, and the amplitude of the video signal keeps no greater than the threshold value, continues for a period shorter than two seconds. Therefore, the CPU 41 determines that the video signal is present.

The criterion that the period during which the amplitude of the video signal keeps no greater than the threshold value is no shorter than two seconds corresponds to the case in which the transmission of the video signal is halted by a pause function of an external device (not shown) connected to the S-Video/Composite terminal 51. Alternatively, it corresponds to the case in which the external device is a picture recording/reproducing device, and the video data input via the S-Video/Composite terminal 51 is so-called snow noise without any image. When the snow noise is displayed on the screen, since a black or white random noise image is displayed on the screen, the variations or the oblique lines are not displayed on the screen. In such cases, the CPU 41 is prevented from reducing the screen luminance.

Further, in the step S380, if the CPU 41 detects the horizontal sync signal or the amplitude of the video signal is greater than the threshold value, the CPU 41 determines that the video signal is present, and raises the luminance of the backlight 220.

1.2.4. Reception of Signal from Component Terminal

The function in the case in which the present television receiver 100 receives a signal form the Component terminal 52 will hereinafter be explained. If either one of the following criteria is satisfied, it is determined that the video signal is absent in the step S340 of the screen luminance reduction program 300 when receiving the signal from the Component terminal 52.

No horizontal sync signal is detected.

The number of pulses of the horizontal sync signal is out of an effective count range.

In the step S340 of the screen luminance reduction program 300, the CPU 41 judges presence or absence of the horizontal sync signal of the video signal stored in the memory 36. Further, if the CPU 41 determines that the horizontal sync signal is present, the CPU 41 detects the number of pulses of the horizontal sync signal in one frame (the vertical sync period). Further, in the step S380, if the number of pulses of the horizontal sync signal is within the effective count range (the number of pulses of the horizontal sync signal in one frame), and the width of the horizontal sync signal pulse is within a stipulated range, the CPU 41 determines that the video signal is present. Then, the CPU 41 raises the luminance of the backlight 220.

1.2.5. Reception of Signal from HDMI Terminal

The function in the case in which the present television receiver 100 receives a signal form the HDMI terminal 54 will hereinafter be explained. If either one of the following criteria is satisfied, the CPU 41 determines that the video signal is absent in the step S340 of the screen luminance reduction program 300 when receiving the signal from the HDMI terminal 54.

No horizontal sync signal is detected.

The number of pulses of the horizontal sync signal is out of an effective count range.

In the HDMI transmission channels, the video signal and the audio signal are transmitted with a plurality of Transition Minimized Differential Signaling (TMDS) data channels, and the sync signal is transmitted with a single TMDS clock channel. Therefore, in the step S330 of the screen luminance reduction program 300 shown in FIG. 4, the CPU 41 detects the horizontal sync signal transmitted via the TMDS clock channel. Further, if the horizontal sync signal is detected, the CPU 41 detects the number of pulses of the horizontal signal in one frame, and judges whether or not the number thus detected is within a predetermined effective count range. If the horizontal sync signal is not detected, or if the number of the pulses of the horizontal sync signal is equal to or smaller than the effective count range even in the case in which the horizontal sync signal is detected, the CPU 41 determines that no sync signal is present.

Further, in the step S380, if the CPU 41 detects the horizontal sync signal, and determines that the number of the pulses of the horizontal sync signal is within the effective count (the number of pulses of the horizontal sync signal per frame) range, the CPU 41 determines that the horizontal sync signal is present. Then, the CPU 41 raises the luminance of the backlight 220.

1.2.6. Reception of Signal from PC

The function in the case in which the present television receiver 100 receives a signal form the S terminal will hereinafter be explained. If either one of the following criteria is satisfied, the CPU 41 determines that the video signal is absent in the step S340 of the screen luminance reduction program 300 when receiving the signal from the S terminal.

No horizontal sync signal is detected.

No vertical sync signal is detected.

If the CPU 41 detects either one of the horizontal sync signal and the vertical sync signal from the video signal stored in the memory 36 in the step S330 of the screen luminance reduction program 300 shown in FIG. 4, but fails to detect both of the horizontal sync signal and the vertical sync signal, the CPU 41 determines that the video signal is absent.

Further, in the step S380, when the number of pulses of the horizontal sync signal is within an effective count (the number of pulses of the horizontal sync signal in one frame) range, the frequency of the vertical sync signal is within an effective range, and the polarity of the horizontal sync signal and the polarity of the vertical sync signal are the same as the input resolution determined from the horizontal sync signal and the vertical sync signal, the CPU 41 determines that the video signal is present. The reason that the frequency of the vertical sync signal is detected is for preventing the CPU 41 from making misjudgment since there are image signals with the same resolution but different frequencies of the vertical sync signals from each other.

As described hereinabove, according to the present invention, by reducing the luminance of the transmitted light itself, it becomes possible to make the variations and the oblique lines on the screen less visible without improving the structure of the liquid crystal panel.

It should be noted that it is obvious that the present invention is not limited to the embodiment described above. It is obvious to those skilled in the art that the following matters are disclosed as an embodiment of the present invention.

To apply the members replaceable with each other or configurations and so on replaceable with each other disclosed in the embodiments described above with the combination thereof appropriately modified.

To appropriately replace the member, configuration, and so on not disclosed in the embodiments described above and included in the known technology and replaceable with the member, configuration, and so on disclosed in the embodiments described above, or to apply the member, configuration, and so on not disclosed in the embodiments described above and included in the known technology and replaceable with the member, configuration, and so on disclosed in the embodiments described above with the combination thereof modified.

To appropriately replace the member, configuration, and so on disclosed in the embodiments described above with the member, configuration, and so on not disclosed in the embodiments described above and assumed by those skilled in the art to be the replacements of the member, configuration, and so on disclosed in the embodiments described above, or to apply the member, configuration, and so on not disclosed in the embodiments described above and assumed by those skilled in the art to be the replacements of the member, configuration, and so on disclosed in the embodiments described above with the combination thereof modified.

While the invention has been particularly shown and described with respect to preferred embodiment thereof, it should be understood by those skilled in the art that the foregoing and other changes in form and detail may be made therein without departing from the spirit and scope of the invention as defined in the appended claims.

What is claimed is:

1. A liquid crystal display, comprising:

a Twisted Nematic (TN) liquid crystal panel and a backlight for emitting light from behind the liquid crystal panel, and varying transmission of each pixel in the liquid crystal panel based on a video signal, thereby displaying an image with the transmitted light that is transmitted through each pixel of the liquid crystal panel;

a video signal reception section for receiving the video signal contained in a Transport Stream of digital television broadcasting signal;

a signal input detection section for detecting the video signal based on a table which records channel numbers contained in the Transport stream;

a luminance control section for controlling the luminance of the backlight with Pulse Width Modulation (PWM) control for varying a duty ratio of a pulse signal;

a control section for outputting a control signal to the luminance control section so that the luminance control section varies the duty ratio of the pulse signal;

a table for storing a luminance control range that has a range of value which can be set by an operation input; wherein when the video signal is detected by the signal input detection section, the control section outputs the control signal so that the luminance control section controls the luminance of the backlight based on the luminance control range and when the video signal is not detected by the signal input detection section, the control section outputs the control signal so that the luminance control section reduces the value of the luminance of the backlight lower than the minimum value of the luminance control range.

2. The liquid crystal display according to claim 1, further comprising:

a solid color screen display section for making the liquid crystal panel to display a solid color image when the video signal is not detected by the signal input detection section.

3. The liquid crystal display according to claim 1, wherein the control section instructs the luminance control section to increase the luminance of the backlight in a phased manner in the case in which the signal input detection section detects the video signal after the control section makes the luminance control section perform luminance control for reducing the luminance of the backlight.

4. The liquid crystal display according to claim 1, wherein the video signal reception section has a plurality of input units for receiving the video signal of a different kind of system, and the signal input detection section switches detection methods of the video signal in accordance with the input units for the selected video signal.

5. The liquid crystal display according to claim 1, wherein, if the signal input detection section can not detect a channel number corresponding to selected channel in the table the signal input detection section determines the video signal is not detected.

6. The liquid crystal display according to claim 1, wherein the Transport Stream includes in a Identifier for identifying the place of the received digital television broadcasting where the video signal of each channel is stored, if the signal input detection section can not detect the Identifier corresponding to selected channel for predetermined time the signal input detection section determines the video signal is not detected.

7. A liquid crystal display, comprising:

a Twisted Nematic (TN) liquid crystal panel and a backlight for emitting light from behind the liquid crystal panel, and varying transmission of each pixel in the liquid crystal panel based on a video signal, thereby displaying an image with the transmitted light that is transmitted through each pixel of the liquid crystal panel;

a video signal reception section for receiving the video signal transmitted with a HDMI transmission channels;

a signal input detection section for detecting the video signal based on a clock signal transmitted with the HDMI transmission channels and a sync signal in one frame of the video signal;

a luminance control section for controlling the luminance of the backlight with Pulse Width Modulation (PWM) control for varying a duty ratio of a pulse signal;

a control section for outputting a control signal to the luminance control section so that the luminance control section varies the duty ratio of the pulse signal;

a table for storing a luminance control range that has a range of value which can be set by the operation input; wherein when the video signal is detected by the signal input detection section, the control section outputs the control signal so that the luminance control section controls the luminance of the backlight based on the luminance control range and when the video signal is not detected by the signal input detection section, the control section outputs the control signal so that the luminance control section reduces the value of the luminance of the backlight lower than the minimum value of the luminance control range.

8. A liquid crystal display, comprising:

a Twisted Nematic (TN) liquid crystal panel and a backlight for emitting light from behind the liquid crystal panel, and varying transmission of each pixel in the liquid crystal panel based on a video signal, thereby displaying an image with the transmitted light that is transmitted through each pixel of the liquid crystal panel;

a video signal reception section for receiving the video signal inputted through an S terminal;

a signal input detection section for detecting the video signal based on a sync signal in one frame of the video signal;

a luminance control section for controlling the luminance of the backlight with Pulse Width Modulation (PWM) control for varying a duty ratio of a pulse signal;

a control section for outputting a control signal to the luminance control section so that the luminance control section varies the duty ratio of the pulse signal;

a table for storing a luminance control range that has a range of value which can be set by the operation input; wherein when the video signal is detected by the signal input detection section, the control section outputs the control signal so that the luminance control section controls the luminance of the backlight based on the luminance control range and when the video signal is not detected by the signal input detection section, the control section outputs the control signal so that the luminance control section reduces the value of the luminance of the backlight lower than the minimum value of the luminance control range.

* * * * *